US007284539B1

(12) United States Patent
Fukasawa

(10) Patent No.: US 7,284,539 B1
(45) Date of Patent: Oct. 23, 2007

(54) FUEL PRESSURE CONTROLLER FOR DIRECT INJECTION INTERNAL COMBUSTION ENGINE

(75) Inventor: Osamu Fukasawa, Nagoya (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/702,581

(22) Filed: Feb. 6, 2007

(30) Foreign Application Priority Data

Feb. 15, 2006 (JP) ..... 2006-038105

(51) Int. Cl.
*F02M 37/04* (2006.01)

(52) U.S. Cl. ..... 123/506; 123/456; 123/467

(58) Field of Classification Search ..... 123/506, 123/467, 458, 494, 446, 456, 179.17, 357, 123/447
See application file for complete search history.

(56) References Cited

U.S. PATENT DOCUMENTS 5,505,180 A * 4/1996 Otterman et al. ..... 123/497
5,638,789 A * 6/1997 Hayner ..... 123/357
5,771,864 A * 6/1998 Morishita et al. ..... 123/456
6,065,436 A * 5/2000 Koga et al. ..... 123/179.17
6,131,548 A * 10/2000 Yano ..... 123/456
6,257,204 B1 7/2001 Kamijo et al.
2005/0045158 A1* 3/2005 Takahashi ..... 123/506

FOREIGN PATENT DOCUMENTS

JP 2004-293354 10/2004
JP 2005-133649 5/2005

* cited by examiner

*Primary Examiner*—Carl S. Miller
(74) *Attorney, Agent, or Firm*—Nixon & Vanderhye P.C.

(57) ABSTRACT

A fuel pressure control device has a feedback control section for setting a feedback control amount (F/B control amount) in accordance with a deviation between target fuel pressure and actual fuel pressure and a feedforward control section for setting a feedforward control amount (F/F control amount) in accordance with a required fuel injection amount and engine rotation speed. When an engine operation state is an off-idling condition, F/F-F/B combination control for validating the F/F control amount and for setting a control amount of a high-pressure pump by adding the F/F control amount to the F/B control amount is performed. When the engine operation state changes from the off-idling condition to an idling condition, control is switched to F/B single control for invalidating the F/F control amount and for using only the F/B control amount.

13 Claims, 12 Drawing Sheets

FUEL PRESSURE CONTROLLER FOR DIRECT INJECTION INTERNAL COMBUSTION ENGINE

CROSS REFERENCE TO RELATED APPLICATION

This application is based on and incorporates herein by reference Japanese Patent Application No. 2006-38105 filed on Feb. 15, 2006.

BACKGROUND OF THE INVENTION

1. Field of the Invention

The present invention relates to a fuel pressure controller of a direct injection internal combustion engine for controlling a discharge amount of a high-pressure pump, which supplies high-pressure fuel to an injector, through feedforward control and feedback control.

2. Description of Related Art

A period from injection to combustion of fuel is shorter in a direct injection engine that injects fuel directly into a cylinder than in an intake port injection engine that injects the fuel into an intake port. The direct injection engine cannot have a sufficient time for atomizing the injected fuel. Accordingly, the direct injection engine has to atomize the injected fuel by increasing injection pressure to high pressure. The direct injection engine pressurizes the fuel, which is drawn from a fuel tank with a low-pressure fuel pump, to high pressure and pressure-feeds the high-pressure fuel to an injector with a high-pressure pump driven by a camshaft of the engine. The direct injection engine senses pressure of the fuel (fuel pressure) supplied to the injector with a fuel pressure sensor and controls a discharge amount of the high-pressure pump (valve closing time of fuel pressure control valve) to conform the sensed fuel pressure to target fuel pressure.

A recent direct injection engine sets the target fuel pressure for each operation area and controls the fuel pressure in a wide range as shown in FIG. 4. In FIG. 4, Tr represents required torque and Ne is engine rotation speed. Thus, the fuel pressure is maintained at high pressure about 8 MPa even during an idling immediately before the engine is stopped. Therefore, the fuel leaking from the injector while the engine is not operating increasers. The leak fuel stays in the cylinder and is discharged at next engine start without being combusted. As a result, exhaust emission as of the start is deteriorated. As shown in FIG. 6, the leak fuel L increases as the fuel pressure P increases. Therefore, the leak fuel can be effectively reduced by decreasing the fuel pressure when the engine is not operating.

Generally, in the direct injection engine, the injector performs the injection two or three times for each fuel discharge from the high-pressure pump. There is a possibility that following performance of actual fuel pressure to follow a change in target fuel pressure cannot be ensured during a transitional period if the fuel pressure control (discharge amount control of high-pressure pump) is performed only through feedback control. Therefore, as described in Japanese Patent No. 3633388, feedforward control estimating and setting a control amount in accordance with a required fuel injection amount is used in addition to the feedback control setting the control amount in accordance with a deviation between the target fuel pressure and the actual fuel pressure. Thus, the following performance of the actual fuel pressure to follow the change of the target fuel pressure during the transitional period can be improved.

However, in this scheme, if the engine is stopped without performing the injection immediately after the high-pressure pump discharges the fuel corresponding to the two or three injections due to the feedforward control immediately before the engine stops, the engine is stopped in a state in which the fuel pressure P is increased largely by the discharge from the high-pressure pump immediately before the stopping of the engine as shown by a chained line in FIG. 7. In FIG. 7, $t_s$ represents the time when the engine stops. Thus, the leak fuel increases further.

As a countermeasure, JP-A-2005-133649 describes that a return pipe is connected to a delivery pipe, which distributes the high-pressure fuel to the injectors, through an electromagnetic relief valve. When an engine stop signal is detected, the electromagnetic relief valve is opened to return the fuel from the delivery pipe to the fuel tank through the return pipe, decreasing the fuel pressure.

However, since this structure requires the electromagnetic relief valve, a drive circuit of the electromagnetic relief valve and the return pipe, increase in a cost is inevitable. The high-pressure fuel in the delivery pipe is rapidly depressurized to proximity of an atmospheric pressure (pressure in fuel tank) and is returned to the fuel tank as the electromagnetic relief valve opens. Accordingly, vapor (air bubble) is easily generated in the fuel returned to the fuel tank. There is a possibility that the vapor is suctioned by the fuel pump at the next start.

JP-A-2004-293354 describes that the fuel injection is continued even after the engine stop condition is established. Then, the fuel injection is stopped to stop the engine when the actual fuel pressure decreases to the target fuel pressure. However, in this scheme, a delay is caused between the time when the engine stop condition is established and the time when the engine actually stops. Accordingly, there is a possibility that an operator feels discomfort.

As described above, in conventional technologies aiming to solve the problem of the oil-tightness in the system controlling the discharge amount of the high-pressure pump through F/F-F/B combination control using the feedforward control and the feedback control in combination, problems of the cost increase, the vapor generation and the delay in the engine stop timing can be caused.

SUMMARY OF THE INVENTION

It is an object of the present invention to provide a fuel pressure controller of a direct injection internal combustion engine controlling a discharge amount of a high-pressure pump through F/F-F/B combination control using feedforward control and feedback control in combination, the fuel pressure controller enabling reduction of fuel leak when the engine is not operating while inhibiting problems of increase in a cost, vapor generation and a delay in engine stop timing caused in conventional leak fuel reduction technologies.

According to an aspect of the present invention, a fuel pressure controller has a fuel pressure sensing device, a target fuel pressure setting device and a fuel pressure control device. The fuel pressure sensing device senses fuel pressure supplied from a high-pressure pump to an injector. The target fuel pressure setting device sets target fuel pressure in accordance with an operation state of an engine. The fuel pressure control device performs F/F-F/B combination control of using feedforward control and feedback control of a discharge amount of the high-pressure pump to conform the fuel pressure sensed by the fuel pressure sensing device to the target fuel pressure. The fuel pressure control device performs F/B single control for controlling the discharge amount of the high-pressure pump through only the feedback control without using the feedforward control when the operation state of the engine is an idling condition.

When the engine stops, the engine stops through the idling condition. Therefore, by performing the F/B single control in the idling condition, the fuel discharge from the high-pressure pump corresponding to two to three times of the fuel injection due to the feedforward control immediately before the stopping of the engine can be prevented. Accordingly, the fuel pressure at the time when the engine is not operating can be decreased than before. Thus, the fuel leak from the injector at the time when the engine is not operating can be decreased and exhaust emission as of the engine start can be improved. In addition, problems of increase in a cost, vapor generation and delay in engine stop timing of the conventional fuel leak reduction technologies can be solved.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
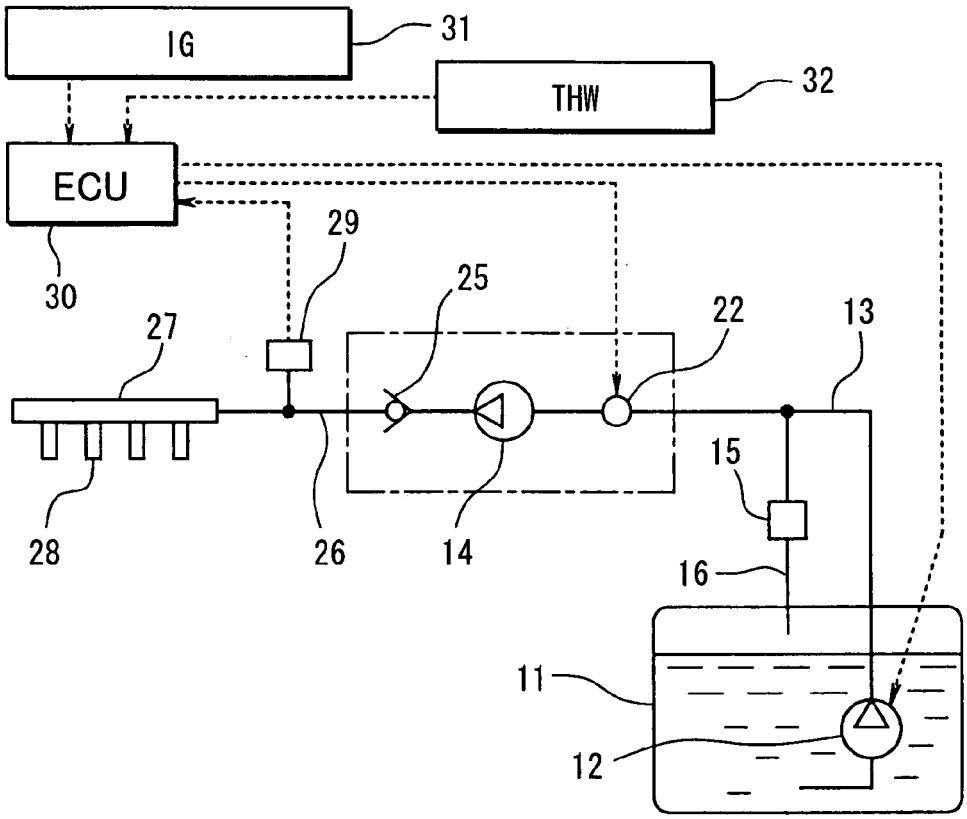
FIG. 1 is a schematic diagram showing a fuel injection system according to a first embodiment of the present invention.

Referring to FIG. 1, a fuel supply system of a direct injection engine according to a first embodiment of the present invention is illustrated. A low-pressure pump 12 for drawing fuel is located inside a fuel tank 11 storing the fuel. The low-pressure pump 12 is driven by an electric motor (not shown) using a battery (not shown) as a power source. The fuel discharged by the low-pressure pump 12 is supplied to a high-pressure pump 14 through a fuel pipe 13. The fuel pipe 13 is connected with a pressure regulator 15. The pressure regulator 15 regulates discharge pressure of the low-pressure pump 12 (fuel supply pressure to high-pressure pump 14) to predetermined pressure. Excessive fuel causing pressure higher than the predetermined pressure is returned into the fuel tank 11 through a fuel return pipe 16.

Figure 2:
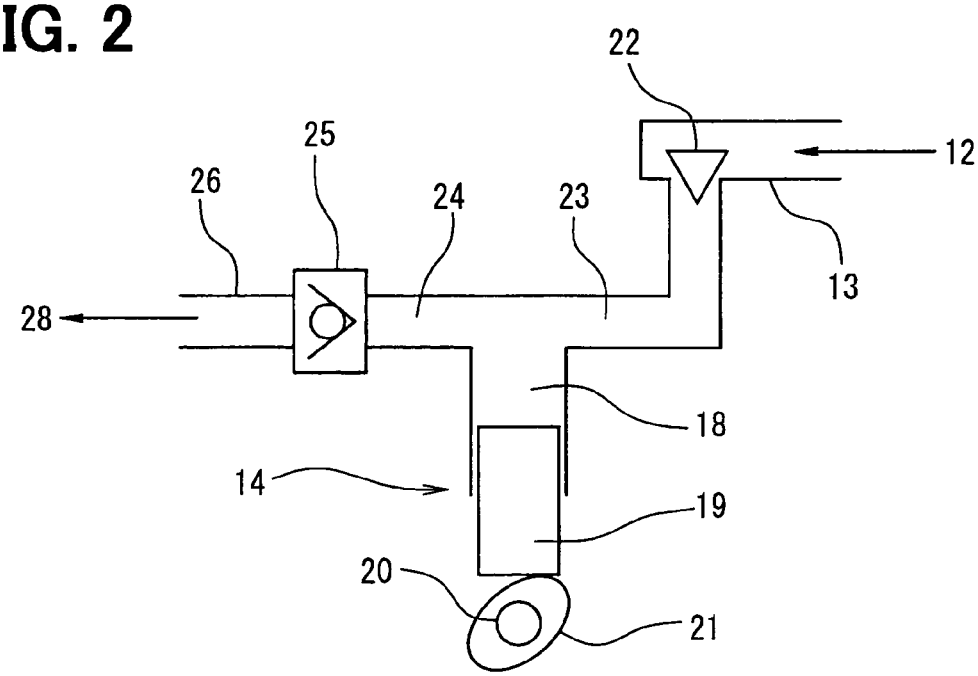
FIG. 2 is a schematic diagram showing a high-pressure pump according to the first embodiment.

As shown in FIG. 2, the high-pressure pump 14 is a piston pump for suctioning/discharging the fuel by reciprocating a piston 19 inside a cylindrical pump chamber 18. The piston 19 is driven by rotational movement of a cam 21 attached to a camshaft 20 of the engine. A fuel pressure control valve 22 provided by a normally-open electromagnetic valve is provided on a suction port 23 side of the high-pressure pump 14. During a suction stroke of the high-pressure pump 14 (when piston 19 descends), the fuel pressure control valve 22 is opened and the fuel is suctioned into the pump chamber 18. During a discharge stroke (when piston 19 ascends), a valve closing period of the fuel pressure control valve 22 (period of valve-closed state from valve closing start timing to top dead center of piston 19) is controlled to control the discharge amount of the high-pressure pump 14. Thus, the fuel pressure (discharge pressure) is controlled.

That is, when the fuel pressure is increased, the valve closing start timing (energization timing) of the fuel pressure control valve 22 is advanced such that the valve closing period of the fuel pressure control valve 22 is lengthened and the discharge amount of the high-pressure pump 14 is increased. When the fuel pressure is decreased, the valve closing start timing (energization timing) of the fuel pressure control valve 22 is delayed such that the valve closing period of the fuel pressure control valve 22 is shortened and the discharge amount of the high-pressure pump 14 is decreased.

A check valve 25 is located on a discharge port 24 side of the high-pressure pump 14 for preventing a backflow of the discharged fuel. As shown in FIG. 1, the fuel discharged from the high-pressure pump 14 is delivered to a delivery pipe 27 through a high-pressure fuel pipe 26. The high-pressure fuel is distributed from the delivery pipe 27 to injectors 28, each of which is attached to a cylinder head of each cylinder of the engine. A fuel pressure sensor 29 for sensing fuel pressure is provided in the high-pressure fuel pipe 26. A coolant temperature sensor 32 for sensing coolant temperature THW is provided in a cylinder block of the engine. 31 in FIG. 1 represents an ignition switch (IG).

Figure 4:
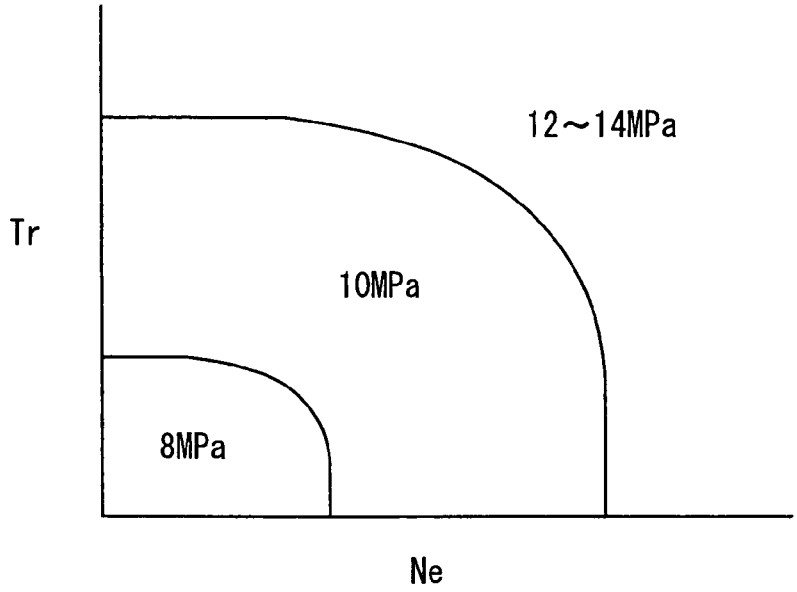
FIG. 4 is a diagram showing an example of a map of normal target fuel pressure.

Outputs of the various sensors are inputted into an engine control circuit (ECU) 30. The ECU 30 is structured mainly by a microcomputer. As shown in FIG. 4, the ECU 30 functions as a target fuel pressure setting device for setting target fuel pressure Pt for each one of operation areas zoned by required torque Tr and engine rotation speed Ne. The ECU 30 also functions as a fuel pressure control device 35 for controlling the discharge amount of the high-pressure pump 14 (energization timing of fuel pressure control valve 22) to conform the fuel pressure Pa sensed by the fuel pressure sensor 29 (actual fuel pressure) to the target fuel pressure Pt.

Figure 3:
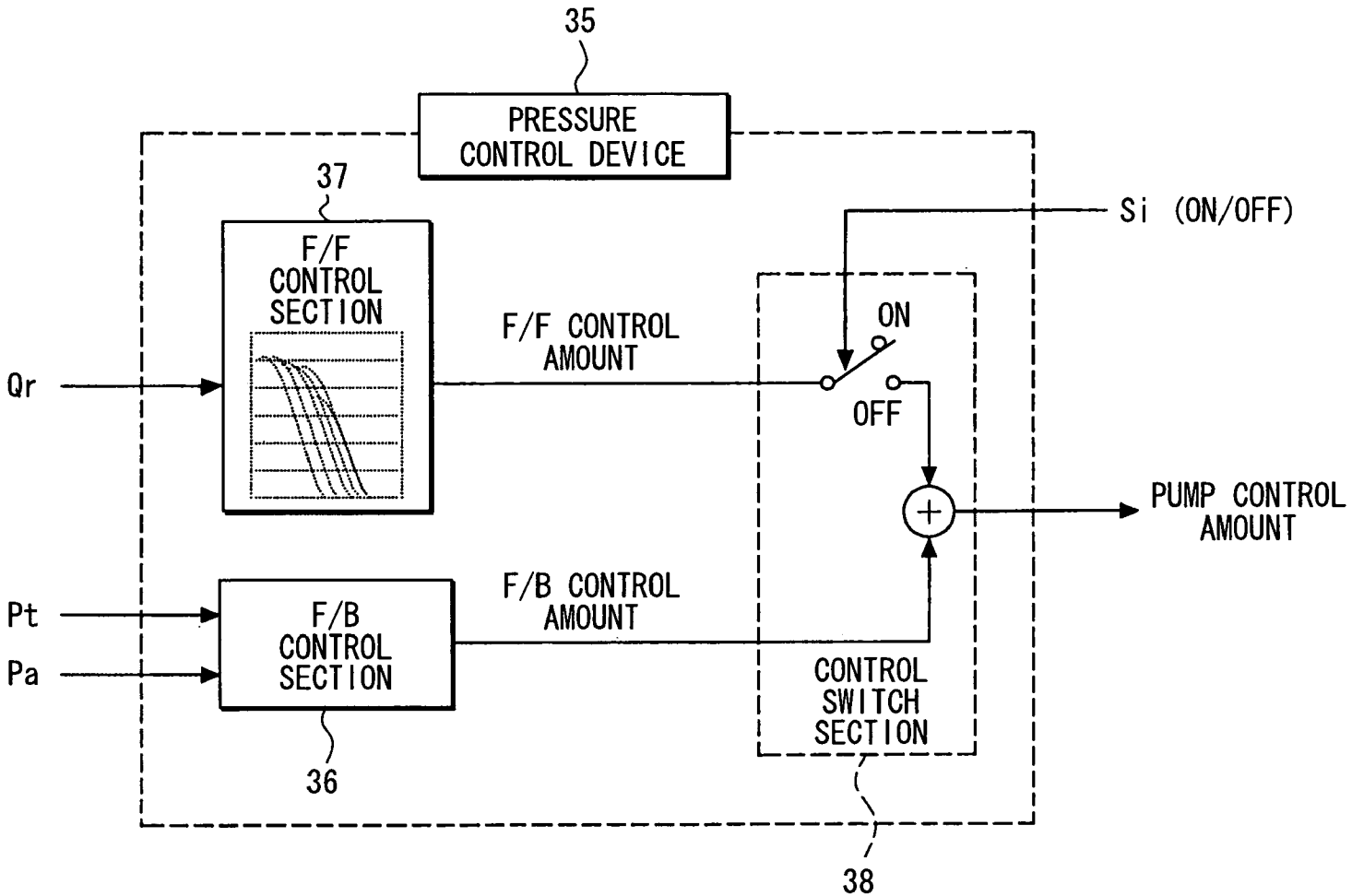
FIG. 3 is a block diagram showing a function of a fuel pressure control device according to the first embodiment.
Figure 5:
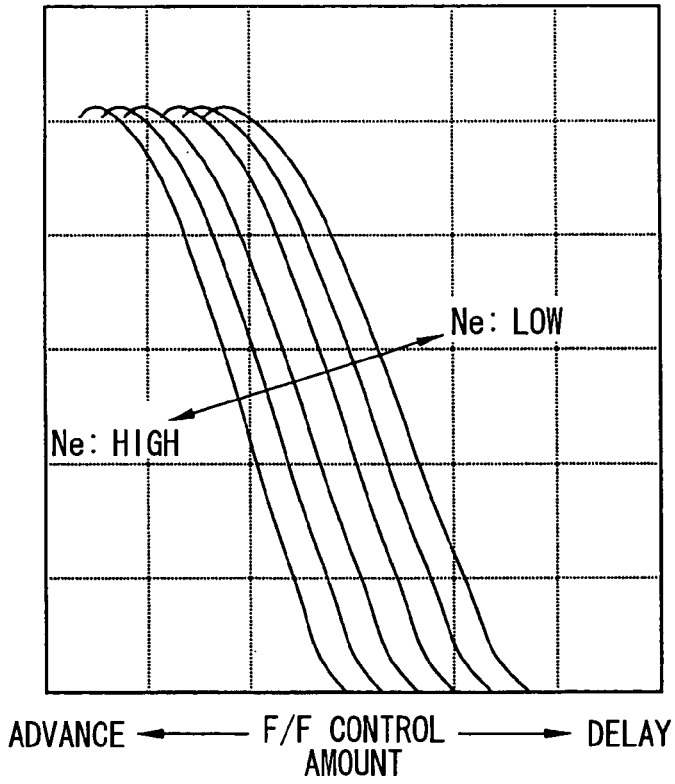
FIG. 5 is a diagram showing an example of a map for setting a F/F control amount according to the first embodiment.

As shown in FIG. 3, the fuel pressure control device 35 has a feedback control section 36, a feedforward control section 37 and a control switch section 38. The feedback control sections 36 sets a feedback control amount (F/B control amount) in accordance with a deviation between the fuel pressure Pa sensed by the fuel pressure sensor 29 (actual fuel pressure) and the target fuel pressure Pt. The feedforward control section 37 sets a feedforward control amount (F/F control amount) based on a map shown in FIG. 5 in accordance with a required fuel injection amount Qr and the engine rotation speed Ne. The control switch section 38 switches a fuel pressure control mode between F/F-F/B combination control and F/B single control.

When the engine operation state is an off-idling condition (idling signal Si: OFF), the control switch section 38 validates the output (F/F control amount) of the feedforward control section 37 and switches the control mode to the F/F-F/B combination control for setting the control amount of the high-pressure pump 14 by adding the output (F/F control amount) of the feedforward control section 37 to the output (F/B control amount) of the feedback control section 36. When the engine operation state is an idling condition (idling signal Si: ON), the control switch section 38 invalidates the output (F/F control amount) of the feedforward control section 37 and switches to the F/B single control for using only the output (F/B control amount) of the feedback control section 36. In this case, the invalidation of the F/F control amount may be performed by completely stopping the calculation operation of the feedforward control section 37 or by stopping the processing of adding the F/F control amount to the F/B control amount without stopping the calculation of the F/F control amount.

When the engine operation state changes from the off-idling condition (idling signal Si: OFF) to the idling condition (idling signal Si: ON), the discharge amount control of the high-pressure pump 14 (fuel pressure control) is switched form the F/F-F/B combination control to the F/B single control for following reasons.

The direct injection engine performs the fuel injection from the injector 28 two to three times for each fuel discharge from the high-pressure pump 14. Therefore, there is a possibility that following performance of the actual fuel pressure to follow the target fuel pressure during a transitional period cannot be ensured if the discharge amount control of the high-pressure pump 14 is performed only through the feedback control. As a countermeasure, the present embodiment performs the F/F-F/B combination control using the feedforward control estimating and setting the control amount in accordance with the required fuel injection amount Qr and the like in addition to the feedback control setting the control amount in accordance with the deviation between the target fuel pressure and the actual fuel pressure during the off-idling period (idling signal: OFF), in which the fuel injection amount becomes large.

Figure 6:
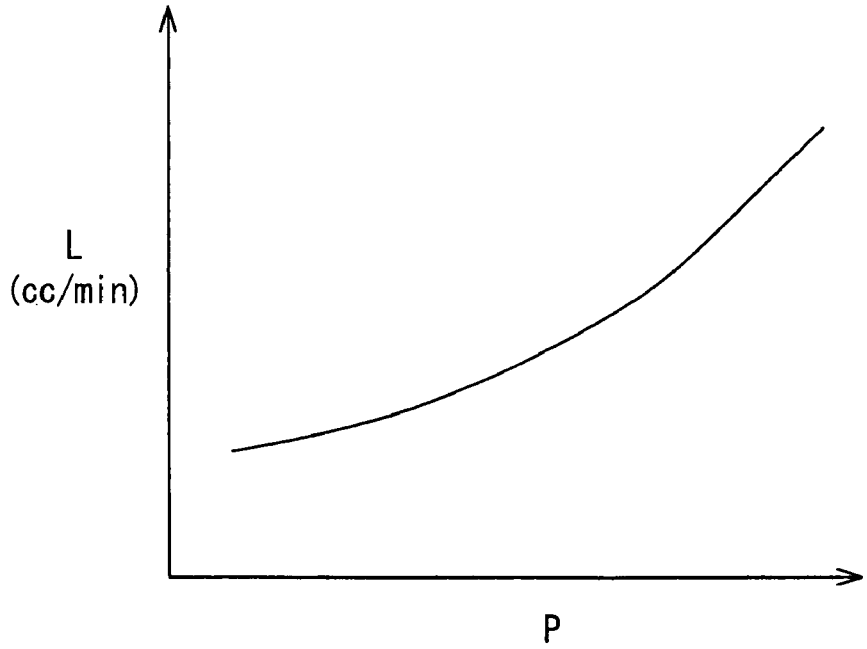
FIG. 6 is a diagram showing a relationship between fuel pressure and fuel leak amount.
Figure 7:
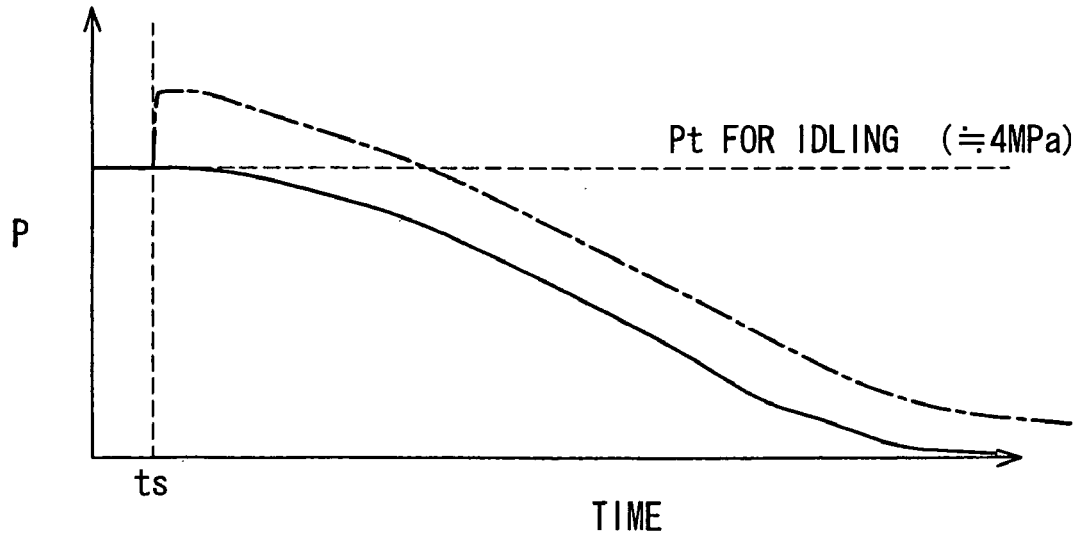
FIG. 7 is a time chart showing an example of transition of the fuel pressure after an engine is stopped.

In a conventional system, there is a possibility that the engine is stopped without performing the injection immediately after the high-pressure pump discharges the fuel corresponding to the two or three injections due to the feedforward control immediately before the engine stops. In such a case, the engine is stopped in a state in which the fuel pressure P is increased largely by the discharge from the high-pressure pump immediately before the stopping of the engine as shown by the chained line in FIG. 7. Therefore, the fuel leaking from the injector when the engine is not operating increasers. The leak fuel stays in the cylinder and is discharged at next start without being combusted. As a result, exhaust emission as of the start is deteriorated. As shown in FIG. 6, the leak fuel L increases as the fuel pressure P increases. The leak fuel L can be reduced effectively by decreasing the fuel pressure P at the time when the engine is not operating.

The engine is stopped through the idling condition (idling signal Si: ON). Therefore, the present embodiment switches the control mode to the F/B single control invalidating the output (F/F control amount) of the feedforward control section 37 and using only the output (F/B control amount) of the feedback control section 36 when the engine operation state changes from the off-idling condition (idling signal Si: OFF) to the idling condition (idling signal Si: ON). Thus, the discharge of the fuel from the high-pressure pump 14 corresponding to the two to three times of the injections due to the feedforward control immediately before the engine stops can be prevented. Accordingly, the fuel pressure P at the time when the engine is not operating can be reduced compared to the conventional technologies and the fuel leak can be reduced.

Moreover, the leak fuel L increases as the fuel pressure P at the time when the engine is not operating increases as shown in FIG. 6. Therefore, in the present embodiment, when the engine operation state changes from the off-idling condition to the idling condition, the target fuel pressure Pt is set at lower pressure (for example, 4 MPa) than usual target fuel pressure Pt and the F/B single control is performed. Thus, the fuel pressure at the time when the engine is not operating can be surely reduced, surely reducing the fuel leak when the engine is not operating.

Figure 8:
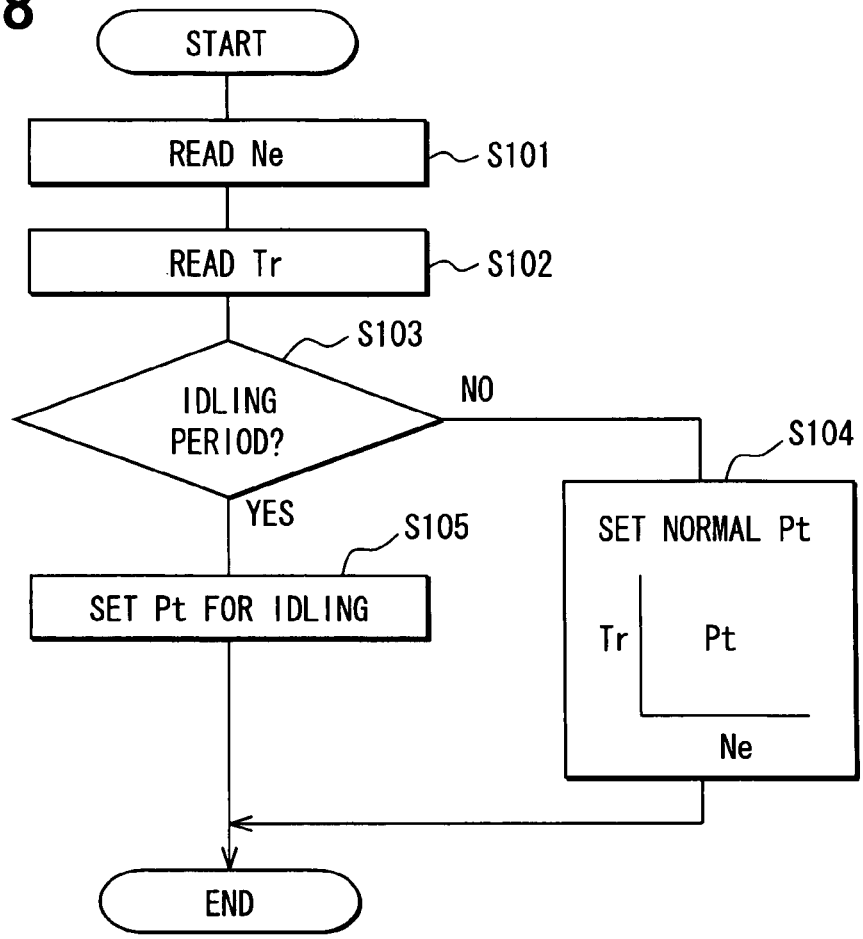
FIG. 8 is a flowchart showing a processing flow of a target fuel pressure calculation routine according to the first embodiment.
Figure 9:
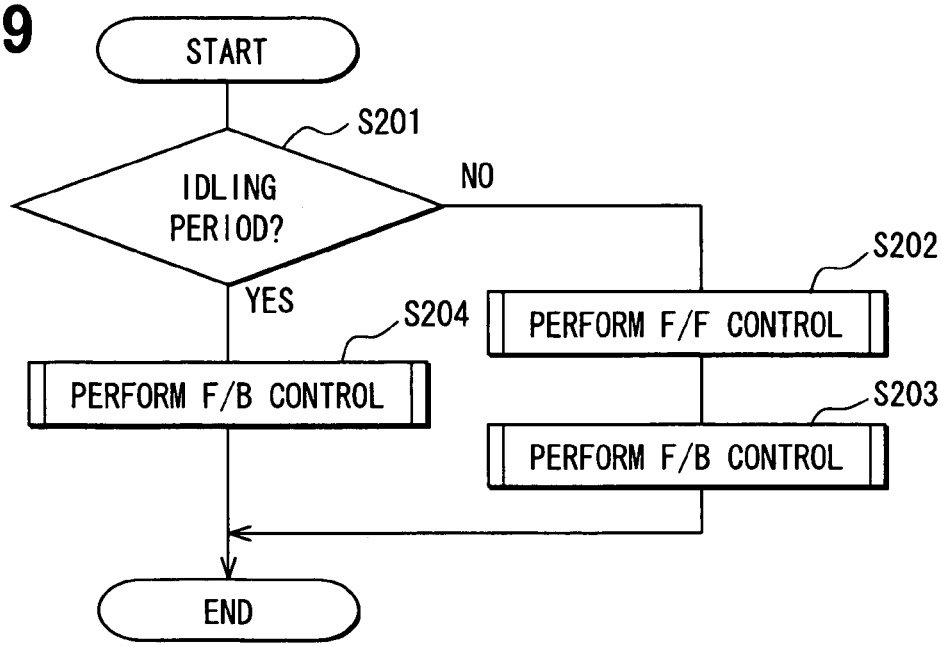
FIG. 9 is a flowchart showing a processing flow of a high-pressure pump control routine according to the first embodiment.

The discharge amount control (fuel pressure control) of the high-pressure pump 14 according to the present embodiment is performed by the ECU 30 based on routines shown in FIGS. 8 and 9.

A target fuel pressure calculation routine shown in FIG. 8 is performed in a predetermined cycle while a power source of the ECU 30 is on. If the routine is started, Step S101 reads the engine rotation speed Ne. Then, the process goes to Step S102 to read required torque Tr as engine torque required by the operator.

Then, the process goes to Step S103 to determine whether an idling period is occurring, i.e., whether the engine is idling. If Step S103 is NO, the process goes to Step S104. Step S104 calculates the normal target fuel pressure Pt corresponding to the present engine rotation speed Ne and required torque Tr in reference to a map of the normal target fuel pressure Pt shown in FIG. 4. The normal target fuel pressure map is set such that the target fuel pressure Pt increases as the engine rotation speed Ne or the required torque Tr increases. For example, the target fuel pressure Pt is set at 8 MPa in a low rotation speed and low load area. The target fuel pressure Pt is set at 10 MPa in a middle rotation speed and middle load area. The target fuel pressure Pt is set at 12-14 MPa in a high rotation speed and high load area.

If Step S103 is YES, the process goes to Step S105 to set the target fuel pressure Pt of the idling period. The target fuel pressure Pt of the idling period is set at fuel pressure (for example, 4 MPa) lower than the fuel pressure control range (for example, 8-14 MPa) of the off-idling period.

A high-pressure pump control routine shown in FIG. 9 is performed in a predetermined cycle while the power source of the ECU 30 is on. If the routine is started, Step S201 determines whether the idling period is occurring, i.e., whether the engine is idling. If Step S201 is NO, the process goes to Step S202 to perform the F/F-F/B combination control. Step S202 performs the feedback control (F/B control) for setting the F/B control amount in accordance with the deviation between the fuel pressure Pa (actual fuel pressure) sensed by the fuel pressure sensor 29 and the target fuel pressure Pt. Following Step S203 performs the feedforward control (F/F control) for setting the F/F control amount based on a map shown in FIG. 5 in accordance with the required fuel injection amount Qr and the engine rotation speed Ne.

If Step S201 is YES, the process goes to Step S204 to perform the F/B single control for setting the control amount of the high-pressure pump 14 only through the feedback control.

According to the present embodiment, the control mode is switched to the F/B single control for setting the control amount of the high-pressure pump 14 through only the feedback control during the idling. Therefore, the discharge of the fuel from the high-pressure pump 14 corresponding to the two to three times of the fuel injection due to the feedforward control immediately before the stopping of the engine can be prevented. Accordingly, the fuel pressure P at the time when the engine is not operating can be reduced compared to the conventional technology as shown by a solid line in FIG. 7. Thus, the exhaust emission as of the engine start can be improved by reducing the fuel leak when the engine is not operating, inhibiting the increase in the cost, the vapor generation and the delay in the engine stop timing caused in the conventional fuel leak reduction technologies.

The control mode is switched to the F/B single control during the idling according to the first embodiment. If idle-up control for increasing target idle rotation speed, e.g., before the engine is warmed or when a load of an accessory such as an air-conditioner increases, the target fuel pressure (required fuel injection amount) increases compared to the normal idling. In such a case, there is a possibility that the following performance of the actual fuel pressure to follow the change in the target fuel pressure as of the start of the idle-up control is deteriorated if the feedback control is solely used. Immediately after the operation state changes from the off-idling condition to the idling condition, the actual fuel pressure is still high and the deviation between the target fuel pressure of the idling and the actual fuel pressure is large. In such a case, there is a possibility that the following performance of the actual fuel pressure to follow the target fuel pressure of the idling is deteriorated.

Therefore, a system according to a second embodiment of the present invention provides setting such that the execution condition of the F/B single control is satisfied when the engine is idling and the target fuel pressure Pt (or fuel pressure Pa sensed by fuel pressure sensor 29) is less than a predetermined value. Thus, even during the idling, the F/F-F/B combination control is performed without switching to the F/B single control if the target fuel pressure Pt (or fuel pressure Pa sensed by fuel pressure sensor 29) is less than the predetermined value.

Figure 10:
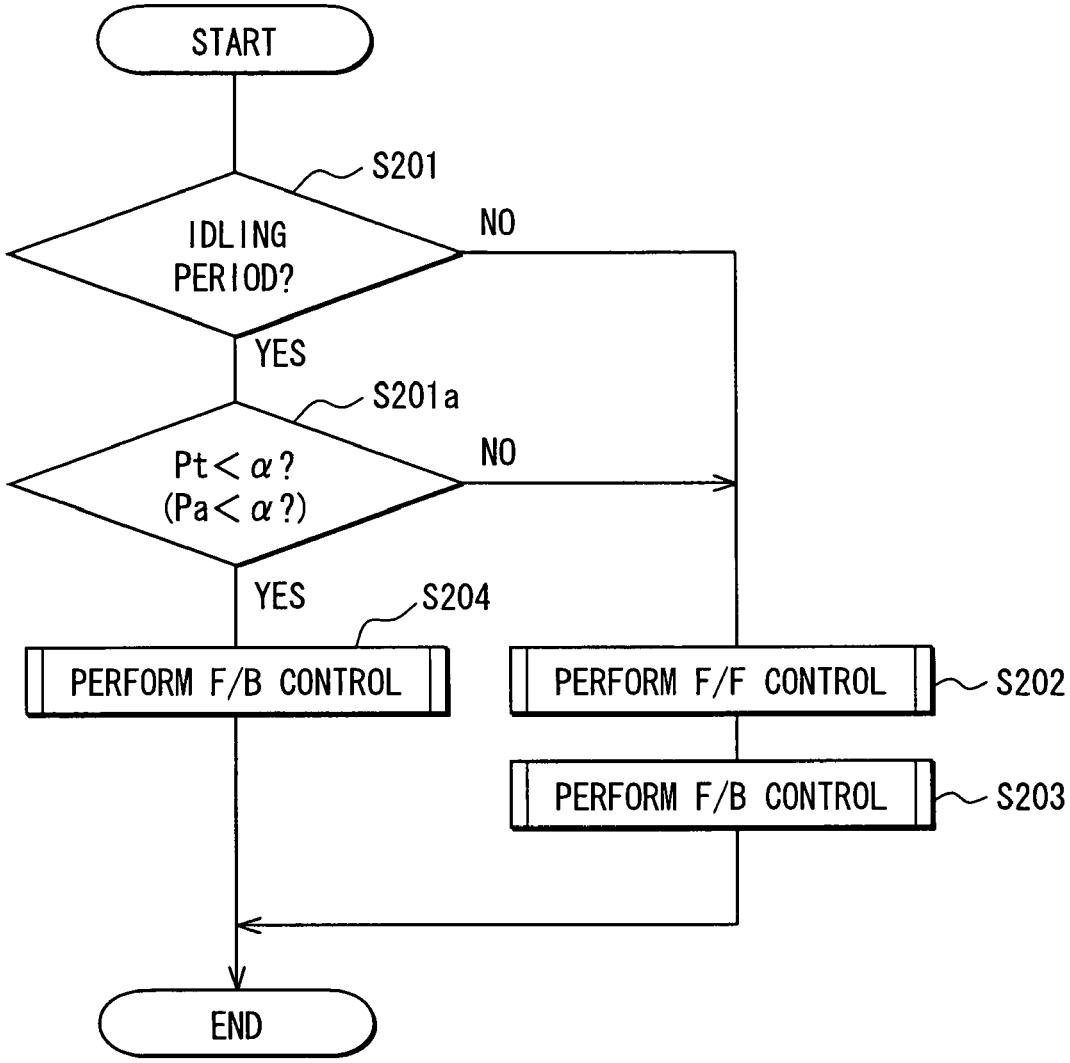
FIG. 10 is a flowchart showing a processing flow of a high-pressure pump control routine according to a second embodiment of the present invention.

In a high-pressure pump control routine shown in FIG. 10 according to the present embodiment, determination processing of Step S201*a* is added after Step S201 of the high-pressure pump control routine shown in FIG. 9 according to the first embodiment. The other steps are the same.

In the high-pressure pump control routine shown in FIG. 10, if Step S201 determines that the engine is idling, the process goes to Step S201*a* to determine whether the target fuel pressure Pt (or fuel pressure Pa sensed by fuel pressure sensor 29) is lower than the predetermined value $\alpha$. The predetermined value $\alpha$ is set at fuel pressure slightly higher than the target fuel pressure Pt in the normal idling and lower than the target fuel pressure Pt at the time when the idle-up control is performed, for example. If Step 201*a* is NO, the process goes to Steps S202, S203 to perform the F/F-F/B combination control even during the idling, as in the off-idling. If Step S201*a* is YES, the process goes to Step S204 to perform the F/B single control.

According to the present embodiment, even during the idling, the F/F-F/B combination control can be performed as in the off-idling if the target fuel pressure Pt (required fuel injection amount Qr) increases compared to the normal idling (or if deviation between target fuel pressure Pt and actual fuel pressure Pa is large immediately after operation state changes from off-idling condition to idling condition), for example, when the idle-up control is performed.

Figure 11:
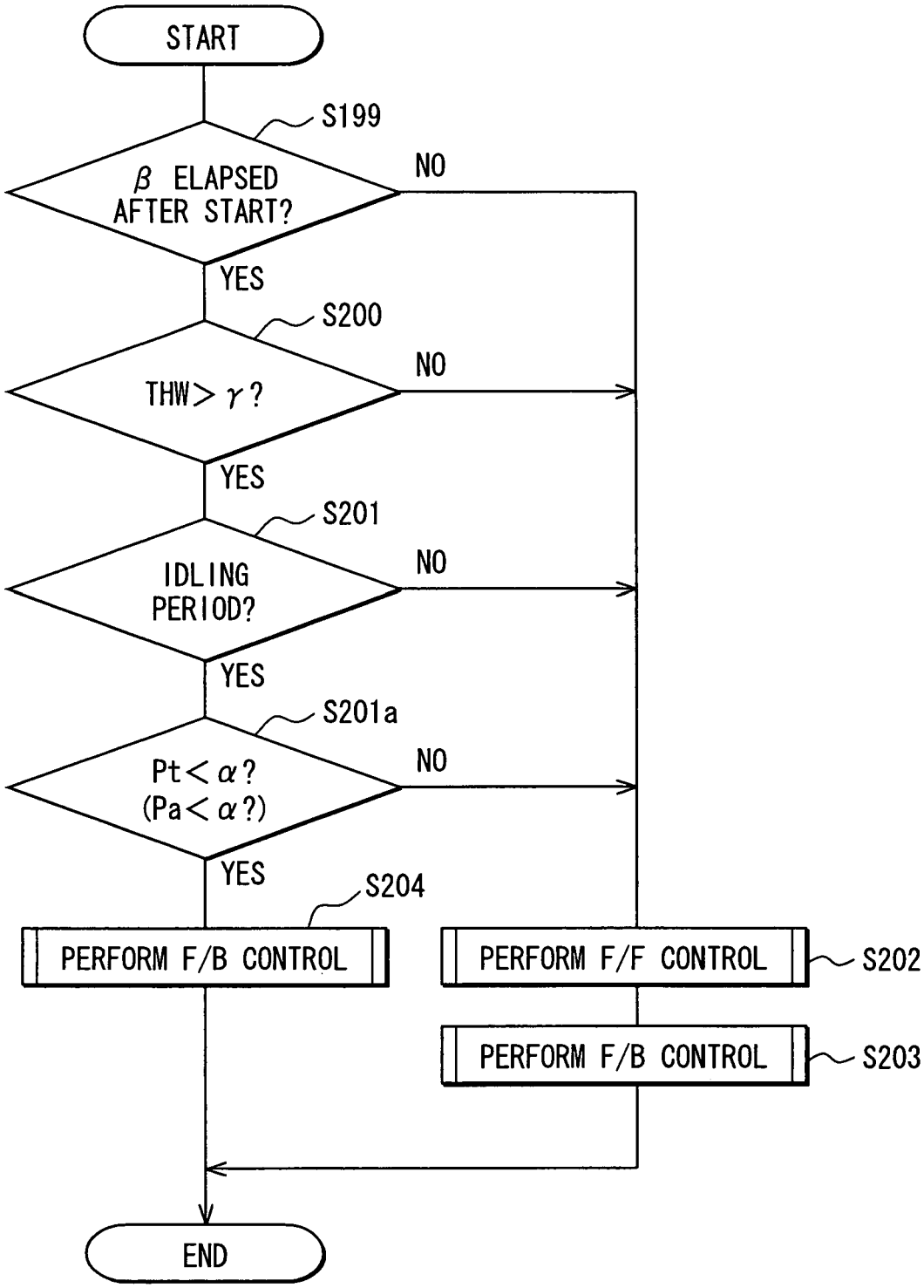
FIG. 11 is a flowchart showing a processing flow of a high-pressure pump control routine according to a third embodiment of the present invention.

A high-pressure pump control routine shown in FIG. 11 according to a third embodiment of the present invention adds determination processing of Steps S199, S200 before Step S201 of the high-pressure pump control routine shown in FIG. 10 according to the second embodiment. The other steps are the same.

If the routine is started, Step S199 determines whether at least a predetermined time $\beta$ has elapsed after the engine is started. The predetermined time $\beta$ is set at a period corresponding to an elapse of time necessary for the engine rotation state to stabilize after a warm restart (restart of warmed engine). If Step S199 is NO, it is determined that the engine rotation state is unstable. Then, regardless of whether the engine is in the idling condition, the process goes to Steps S202, S203 to perform the F/F-F/B combination control.

If Step S199 is YES, the process goes to Step S200. Step S200 determines whether the warm-up of the engine is completed based on whether the coolant temperature THW sensed by the coolant temperature sensor 32 is higher than predetermined coolant temperature y corresponding to warm-up completion temperature. If Step S200 is NO, it is determined that the warm-up of the engine is not completed, and the process goes to Steps S202, S203 to perform the F/F-F/B combination control.

If Step S200 is YES, it is determined that the warm-up of the engine is completed, and the process goes to Step S201 to determine whether the engine is under the idling. If Step S201 is YES, the process goes to Step S201*a* to determine whether the target fuel pressure Pt (or fuel pressure Pa sensed by fuel pressure sensor 29) is lower than the predetermined value a. If Step S201*a* is YES, the process goes to Step S204 to perform the F/B single control.

The execution condition of the F/B single control according to the present embodiment is satisfied when all of following conditions are satisfied.

(1) At least the predetermined period elapses after the engine is started (period immediately after start in which engine rotation is unstable has passed).

(2) The coolant temperature is higher than the predetermined temperature (warm-up of engine is completed).

(3) The idling is occurring.

(4) The target fuel pressure (or fuel pressure sensed by fuel pressure sensor 29) is lower than the predetermined value.

If any one of the conditions (1) to (4) is not satisfied, the execution condition of the F/B single control is not satisfied and the F/F-F/B combination control is performed. Only when all of the conditions (1) to (4) are satisfied, the F/B single control is performed.

According to the present embodiment, the F/F-F/B combination control can be performed even during the idling as in the off-idling if the engine rotation is unstable immediately after the start or if the target fuel pressure (required fuel injection amount) increases compared to the normal idling, for example, when the idle-up control is performed. Thus, the following performance of the actual fuel pressure to follow the target fuel pressure can be ensured.

When the engine operation state changes from the idling condition (idling signal Si: ON) to the off-idling condition (idling signal Si: OFF), the fuel pressure P has to be increased quickly. If the calculation of the control amount (F/F control amount) of the feedforward control is completely stopped during the execution of the F/B single control, the control amount (F/F control amount) of the feedforward control does not work effectively in an initial stage of the start of the F/F-F/B combination control when the control mode is switched from the F/B single control to the F/F-F/B combination control. There is a possibility that the fuel pressure increase delays correspondingly.

Figure 12:
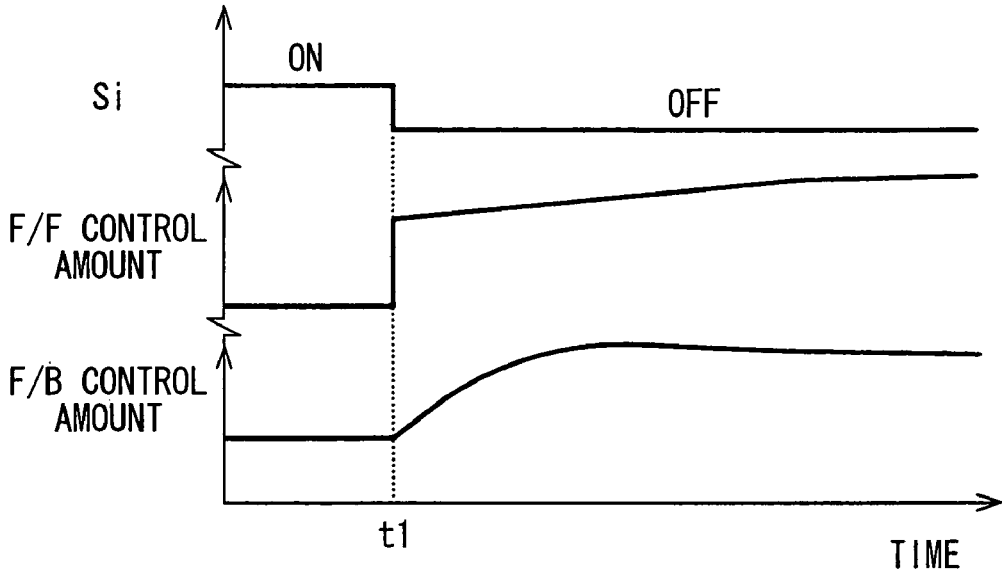
FIG. 12 is a time chart showing a control example according to a fourth embodiment of the present invention.

As a countermeasure, a system according to a fourth embodiment of the present invention continues the processing for internally calculating the F/F control amount even while the engine operation state is the idling condition (idling signal Si: ON) and the F/B single control is performed. The F/F-F/B combination control is immediately started at time t1 when the engine operation state changes from the idling condition (idling signal Si: ON) to the off-idling condition (idling signal Si: OFF) by using the F/F control amount calculated immediately before the engine operation state changes from the idling condition to the off-idling condition as shown in FIG. 12. Thus, when the operation state changes from the idling condition to the off-idling condition, the appropriate F/F control amount starts working effectively from the initial stage of the start of the F/F-F/B combination control. Accordingly, the fuel pressure P can be increased quickly, so the acceleration performance and drivability can be improved.

Figure 13:
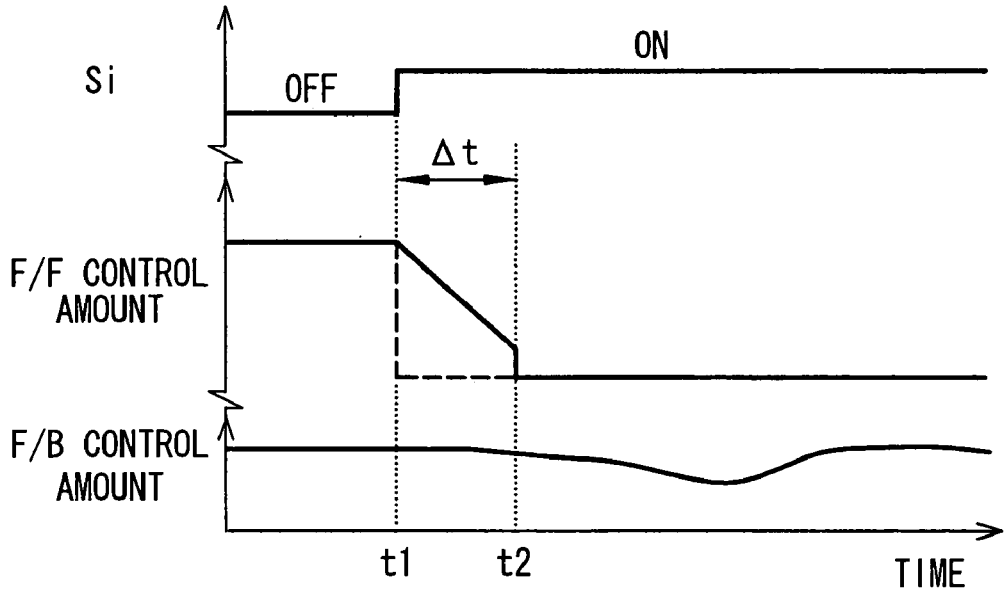
FIG. 13 is a time chart showing a control example according to a fifth embodiment of the present invention.

A system according to a fifth embodiment of the present invention performs gradual change control for gradually decreasing the F/F control amount at time t1 when the engine operation state changes from the off-idling condition (idling signal Si: OFF) to the idling condition (idling signal Si: ON) as shown in FIG. 13. The control is changed to the F/B single control at time t2 when the gradual change control is performed for a predetermined time Δt from time t1. Thus, the rapid change of the F/B control amount before and after the switching to the F/B single control can be averted. As a result, the fuel pressure stability and the engine rotation stability in the initial stage of the transition to the idling condition can be improved.

The execution time of the gradual change control may be set with a timer or the gradual change control may be performed until the F/F control amount decreases to or under a predetermined value (or to substantially zero).

Figure 14:
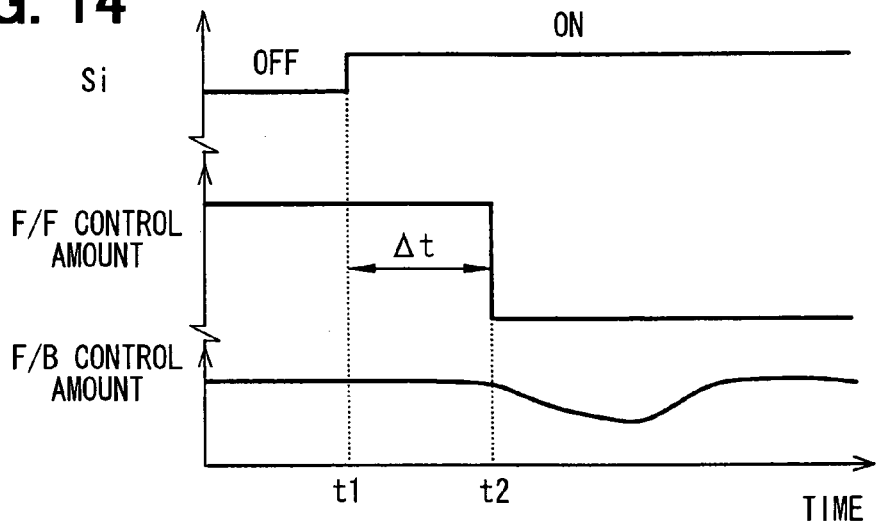
FIG. 14 is a time chart showing a control example according to a sixth embodiment of the present invention.

A system according to a sixth embodiment of the present invention continues the F/F-F/B combination control until a predetermined delay Δt elapses after the engine operation state changes from the off-idling condition (idling signal Si: OFF) to the idling condition (idling signal Si: ON) as shown in FIG. 14. The control mode is changed to the F/B single control at time t2 when the delay Δt elapses after time t1. Thus, the control mode can be switched from the F/F-F/B combination control to the F/B single control when the fuel pressure control state and the engine rotation state stabilize after the engine operation state changes to the idling condition. As a result, the fuel pressure stability and the engine rotation stability at the time when the control mode is switched to the F/B single control can be improved.

The delay Δt may be a predetermined constant time. Alternatively, a time necessary for the fuel pressure control state or the engine operation state to stabilize may be estimated based on the fuel pressure P or the engine operation state (e.g., engine rotation speed Ne) at the time when the operation state changes from the off-idling condition to the idling condition and the delay Δt may be set at the time.

Figure 15:
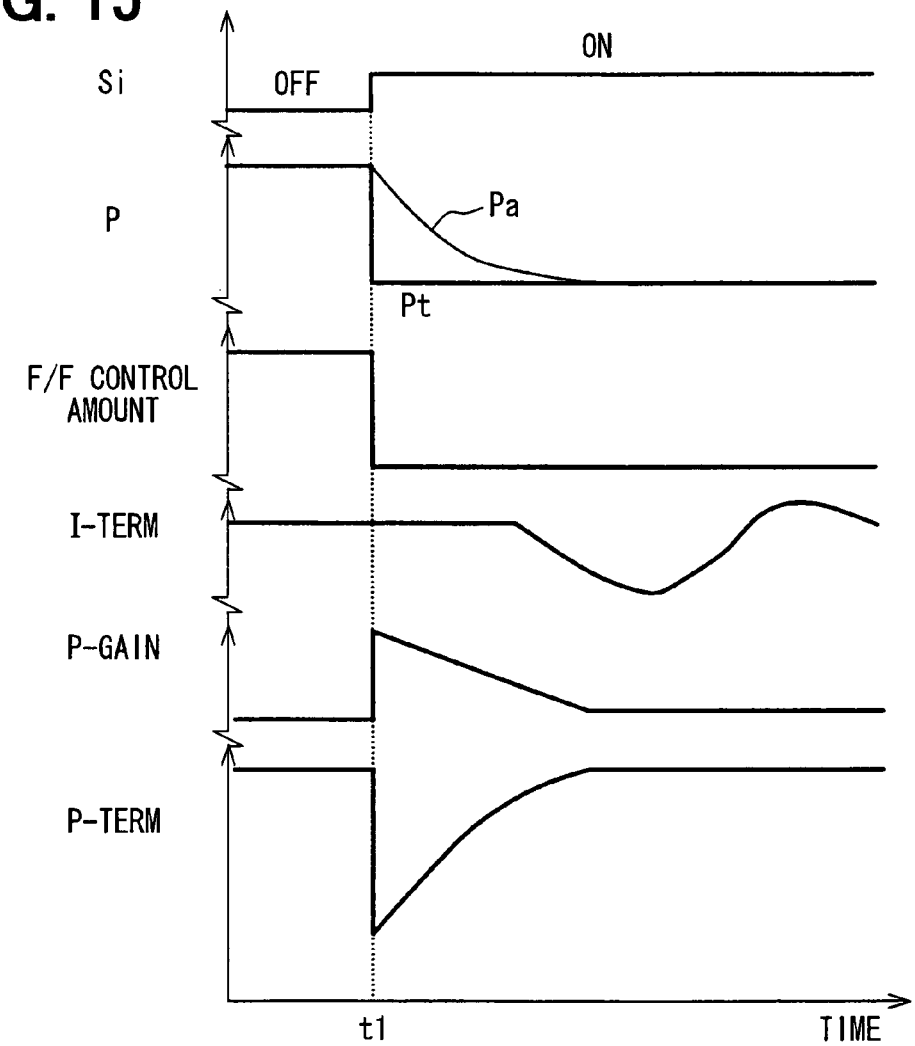
FIG. 15 is a time chart showing a control example according to a seventh embodiment of the present invention.
Figure 16:
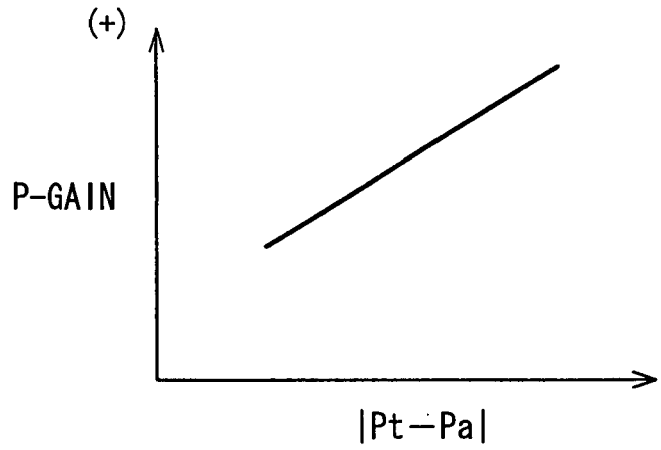
FIG. 16 is a diagram showing an example of a map for setting a proportional gain in accordance with a deviation between target fuel pressure and actual fuel pressure according to the seventh embodiment.

A system according to a seventh embodiment of the present invention reduces the target fuel pressure Pt to the target fuel pressure Pt (for example, 4 MPa) of the idling period at time t1 when the engine operation state changes from the off-idling condition (idling signal Si: OFF) to the idling condition (idling signal Si: ON) as shown in FIG. 15. At the same time, a proportional gain (P-GAIN in FIG. 15) of the feedback control is set based on a map shown in FIG. 16 in accordance with the deviation between the target fuel pressure Pt and the actual fuel pressure Pa (fuel pressure sensed by fuel pressure sensor 29), and the F/B single control using only the feedback control is started. The proportional gain (P-gain) is set based on the map shown in FIG. 16 in accordance with the deviation between the target fuel pressure Pt and the actual fuel pressure Pa even during the F/B single control. Characteristics of the map shown in FIG. 16 are set such that the proportional gain (P-gain) increases as the deviation (absolute value: |Pt-Pa|) between the target fuel pressure Pt and the actual fuel pressure Pa increases.

In this case, the feedback control (F/B single control) may use Pi control calculating a proportional term (P-term) and an integral term (I-term). The F/B control amount of the PI control is summation of the proportional term (P-term) and the integral term (I-term) (F/B control amount=P-term+I-term). Alternatively, the feedback control (F/B single control) may use PID control calculating a differential term (D-term) in addition to the proportional term (P-term) and the integral term (I-term). The F/B control amount of the PID control is summation of the proportional term (P-term), the integral term (I-term) and the differential term (D-term) (F/B control amount=P-term+I-term+D-term). In both of the PI control and the PID control, the proportional term (P-term) is calculated by multiplying the proportional gain (P-gain) by the deviation between the target fuel pressure Pt and the actual fuel pressure Pa (P-term=P-gain×(Pt−Pa)).

In this scheme, the deviation (absolute value) between the target fuel pressure Pt and the actual fuel pressure Pa is large at time t1 when the operation state changes from the off-idling condition to the idling condition as shown in FIG. 15. Therefore, the proportional gain (P-gain) as of the start of the F/B single control is set at a large value. Thus, the proportional term (P-term) of the feedback control (F/B single control) is large from the initial stage of the start of the F/B single control. Accordingly, a sufficient F/B control amount (control amount of high-pressure pump 14) can be ensured from the initial stage of the start of the F/B single control. As a result, the following performance of the actual fuel pressure Pa (sensed fuel pressure) to follow the target fuel pressure Pt during the execution of the F/B single control can be improved.

Figure 17:
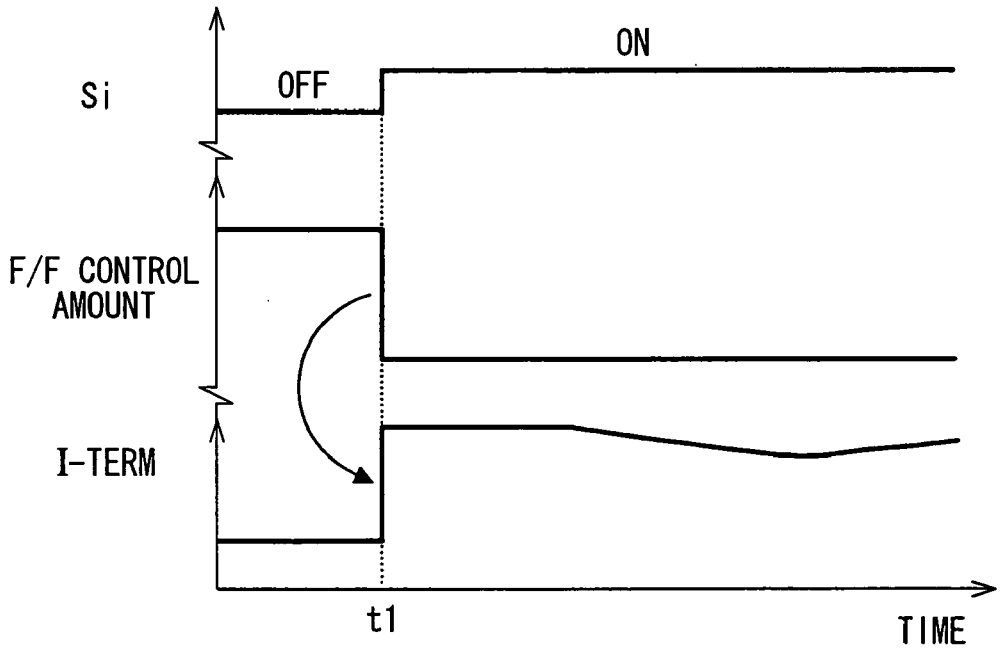
FIG. 17 is a time chart showing a control example according to an eighth embodiment of the present invention.
Figure 18:
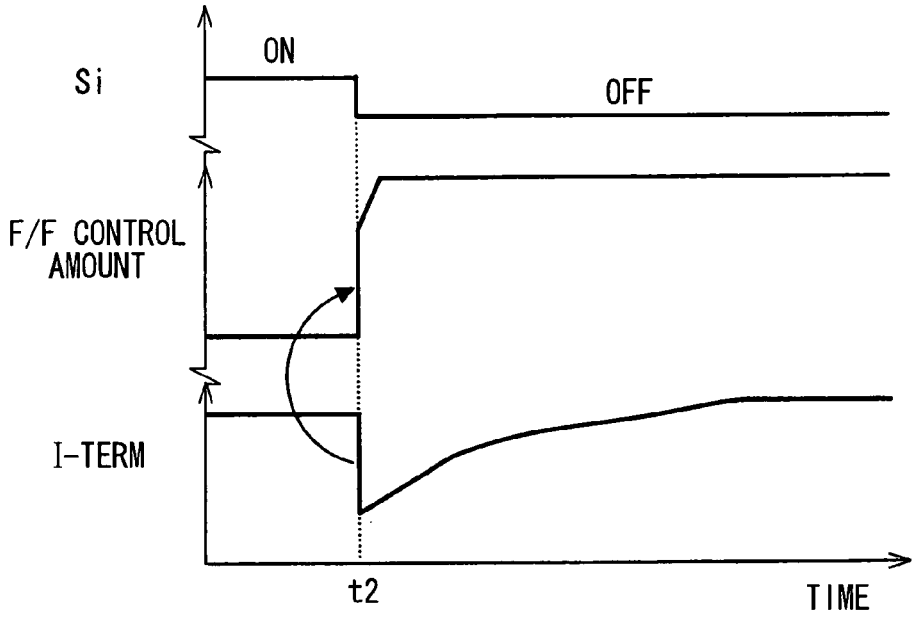
FIG. 18 is a time chart showing another control example according to the eighth embodiment.

Next, a system according to an eighth embodiment of the present invention will be explained in reference to FIGS. 17 and 18. The system according to the present embodiment performs the feedback control (F/B single control) by the PI control or the PID control. As shown in FIG. 17, the control amount (F/F control amount) of the feedforward control is set as an initial value of the integral term (I-term) of the feedback control and the F/B single control is started at time t1 when the engine operation state changes from the off-idling condition (idling signal Si: OFF) to the idling condition (idling signal Si: ON). Then, as shown in FIG. 18, a value of the integral term (I-term) of the feedback control (F/B single control) is set as the initial value of the control amount (F/F control amount) of the feedforward control and the F/F-F/B combination control is started at time t2 when the engine operation state changes from the idling condition (idling signal Si: ON) to the off-idling condition (idling signal Si: OFF).

According to the present embodiment, when the control mode is switched from the F/F-F/B combination control to the F/B single control, the F/F control amount is set as the initial value of the integral term (I-term) of the feedback control and the F/B single control is started. Therefore, when the control is switched form the F/F-F/B combination control to the F/B single control, the rapid change of the control amount of the high-pressure pump 14 across the switching can be averted, enabling stable fuel pressure control.

When the control mode is switched from the F/B single control to the F/F-F/B combination control, the value of the integral term (I-term) of the feedback control (F/B single control) is set as the initial value of the control amount (F/F control amount) of the feedforward control and the F/F-F/B combination control is started. Therefore, the F/F control amount starts working effectively from the initial stage of the start of the F/F-F/B combination control. Thus, the fuel pressure P can be increased quickly after the start of the F/F-F/B combination control. As a result, acceleration performance and drivability can be improved.

Figure 19:
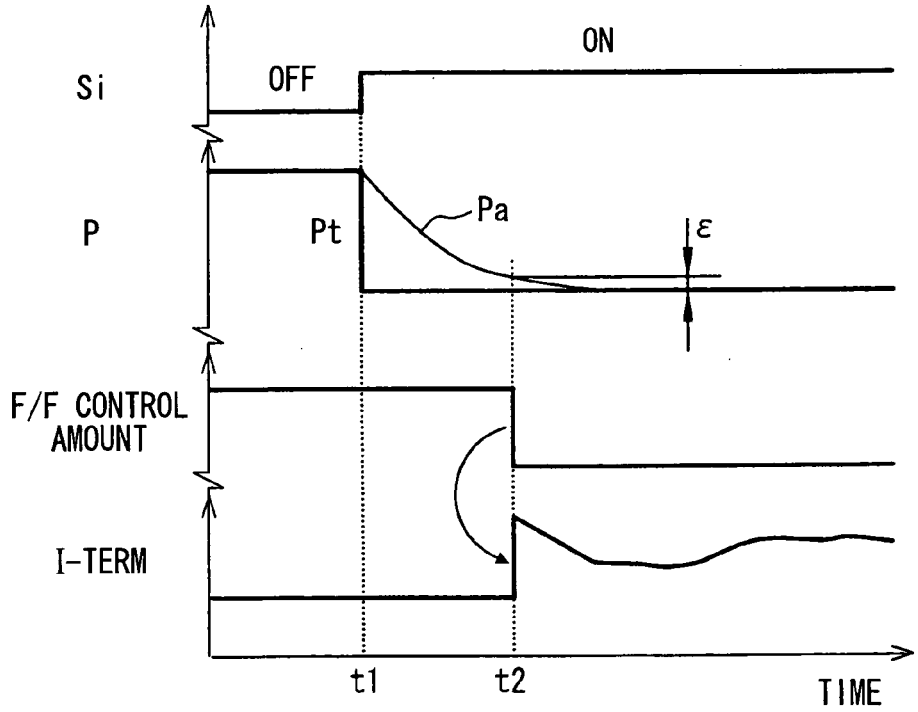
FIG. 19 is a time chart showing a control example according to a ninth embodiment of the present invention.

A system according to a ninth embodiment of the present invention decreases the target fuel pressure Pt to the target fuel pressure Pt of the idling period (for example, 4 MPa) at time t1 when the engine operation state changes from the off-idling condition (idling signal Si: OFF) to the idling condition (idling signal Si: ON) but continues the F/F-F/B combination control for a certain time as shown in FIG. 19. At time t2 when the deviation between the target fuel pressure Pt and the actual fuel pressure Pa (fuel pressure sensed by fuel pressure sensor 29) becomes equal to or less than a predetermined value E, the F/F control amount at the time is set as the initial value of the integral term (I-term) of the feedback control and the control mode is switched from the F/F-F/B combination control to the F/B single control.

Thus, the control mode can be switched from the F/F-F/B combination control to the F/B single control using the suitable integral term (I-term) after the engine operation state changes to the idling condition and the fuel pressure control state stabilizes. As a result, the fuel pressure stability at the time when the control mode is switched to the F/B single control can be improved further.

Figure 20:
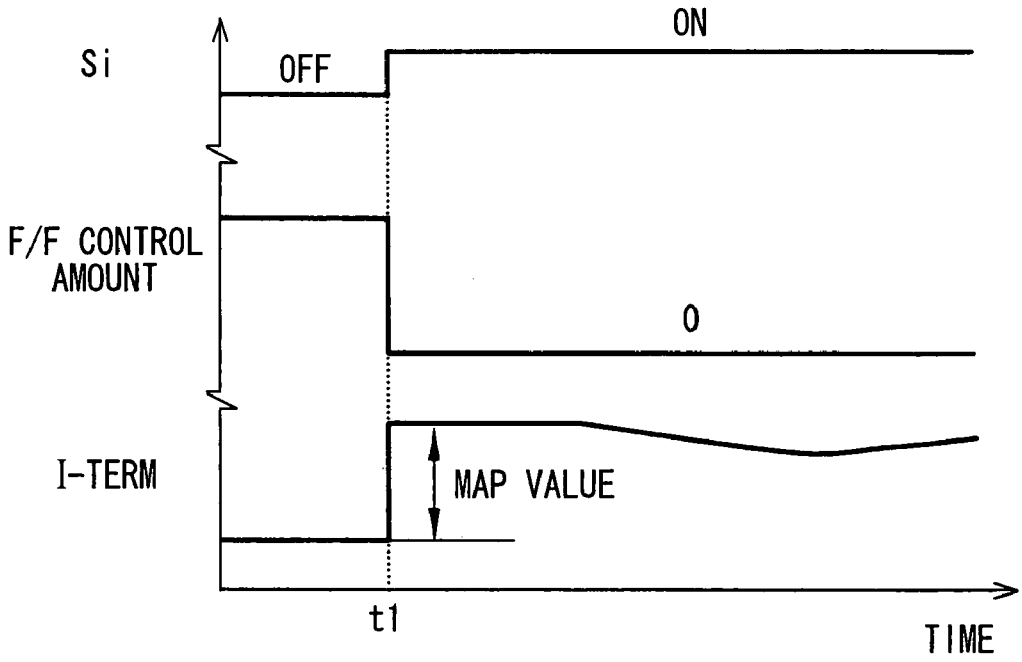
FIG. 20 is a time chart showing a control example according to a tenth embodiment of the present invention.
Figure 21:
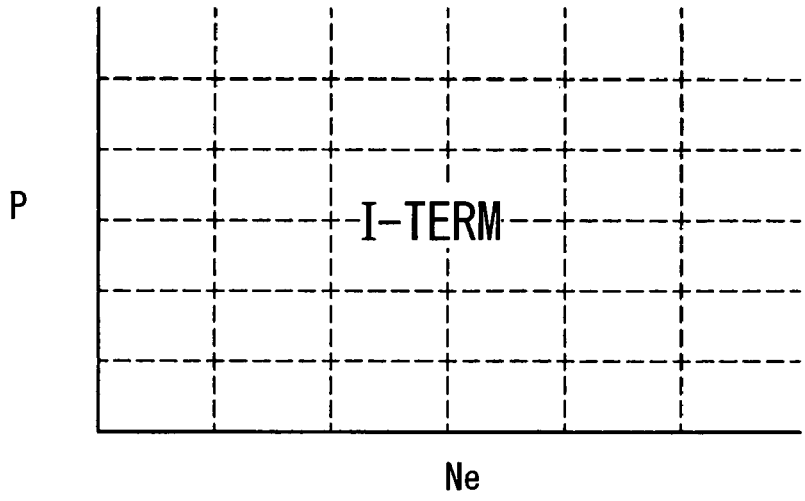
FIG. 21 is a diagram showing a map for setting an integral term in accordance with engine rotation speed and fuel pressure according to the tenth embodiment.

Next, a system according to a tenth embodiment of the present invention will be explained in reference to FIGS. 20 and 21. According to the present embodiment, at time t1 when the engine operation state changes from the off-idling condition (idling signal Si: OFF) to the idling condition (idling signal Si: ON), the initial value of the integral term (I-term) of the feedback control is set in accordance with the engine operation state (such as engine rotation speed Ne) and the fuel pressure P at that time based on an I-term map shown in FIG. 21 and the F/B single control is started as shown in FIG. 20. A map made through adjustment process or the like may be used as the map shown in FIG. 21.

Thus, when the engine operation state changes from the off-idling condition to the idling condition, the F/B single control suitable for the engine operation state or the fuel pressure P at that time can be performed. As a result, stable fuel pressure control is enabled.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel pressure controller of a direct injection internal combustion engine that pressurizes fuel and supplies the fuel to an injector with a high-pressure pump and that injects the fuel directly into a cylinder of the engine through the injector, the fuel pressure controller comprising:

a fuel pressure sensing device that senses fuel pressure supplied from the high-pressure pump to the injector;

a target fuel pressure setting device that sets target fuel pressure in accordance with an operation state of the engine; and a fuel pressure control device that controls a discharge amount of the high-pressure pump by F/F-F/B combination control using feedforward control and feedback control to conform the fuel pressure sensed by the fuel pressure sensing device to the target fuel pressure, wherein the fuel pressure control device performs F/B single control for controlling the discharge amount of the high-pressure pump through only the feedback control without using the feedforward control when an operation state of the engine is an idling condition.

2. The fuel pressure controller as in claim 1, wherein the fuel pressure control device performs the F/B single control by setting the target fuel pressure at a value lower than usual target fuel pressure through the target fuel pressure setting device when the operation state of the engine changes from an off-idling condition to the idling condition.

3. The fuel pressure controller as in claim 1, wherein the fuel pressure control device performs the F/B single control when the operation state of the engine is the idling condition and the target fuel pressure or the fuel pressure sensed by the fuel pressure sensing device is equal to or lower than a predetermined value.

4. The fuel pressure controller as in claim 1, wherein the fuel pressure control device continues processing for calculating a control amount of the feedforward control even while the operation state of the engine is the idling condition and the F/B single control is performed, and the fuel pressure control device, when the operation state of the engine changes from the idling condition to an off-idling condition, immediately starts the F/F-F/B combination control by using the control amount of the feedforward control calculated immediately before the operation state of the engine changes from the idling condition to the off-idling condition.

5. The fuel pressure controller as in claim 1, wherein the fuel pressure control device performs gradual change control for gradually decreasing a control amount of the feedforward control for a certain time when the operation state of the engine changes from an off-idling condition to the idling condition and then switches to the F/B single control.

6. The fuel pressure controller as in claim 1, wherein the fuel pressure control device continues the F/F-F/B combination control until a predetermined time elapses after the operation state of the engine changes from an off-idling condition to the idling condition and switches to the F/B single control when the predetermined time elapses.

7. The fuel pressure controller as in claim 1, wherein the fuel pressure control device sets a proportional gain of the feedback control in accordance with a deviation between the fuel pressure sensed by the fuel pressure sensing device and the target fuel pressure and starts the F/B single control when the operation state of the engine changes from an off-idling condition to the idling condition.

8. The fuel pressure controller as in claim 1, wherein the fuel pressure control device obtains a control amount in the feedback control by calculating at least a proportional term and an integral term, and the fuel pressure control device sets a control amount of the feedforward control as an initial value of the integral term of the feedback control and starts the F/B single control when the operation state of the engine changes from an off-idling condition to the idling condition.

9. The fuel pressure controller as in claim 8, wherein the fuel pressure control device sets a value of the integral term of the feedback control as an initial value of the control amount of the feedforward control and starts the F/F-FIB combination control when the operation state of the engine changes from the idling condition to the off-idling condition.

10. The fuel pressure controller as in claim 8, wherein the fuel pressure control device sets the control amount of the feedforward control as the initial value of the integral term of the feedback control and starts the F/B single control when the operation state of the engine changes from the off-idling condition to the idling condition and the deviation between the fuel pressure sensed by the fuel pressure sensing device and the target fuel pressure becomes equal to or less than a certain value.

11. The fuel pressure controller as in claim 1, wherein the fuel pressure control device obtains a control amount in the feedback control by calculating at least a proportional term and an integral term, and the fuel pressure control device sets an initial value of the integral term of the feedback control in accordance with the present operation state and the present fuel pressure and starts the F/B single control when the operation state of the engine changes from an off-idling condition to the idling condition.

12. The fuel pressure controller as in claim 1, wherein the fuel pressure control device continues the F/F-F/B combination control without switching to the F/B single control even if the operation state of the engine changes from an off-idling condition to the idling condition in the case where an elapse of time since a start of the engine is within a given period or in the case where coolant temperature of the engine is equal to or lower than predetermined temperature.

13. A fuel pressure control method of a direct injection internal combustion engine that pressurizes fuel and supplies the fuel to an injector with a high-pressure pump and that injects the fuel directly into a cylinder of the engine through the injector, the fuel pressure control method comprising the steps of:

sensing the fuel pressure supplied from the high-pressure pump to the injector;

setting target fuel pressure in accordance with an operation state of the engine; and controlling a discharge amount of the high-pressure pump by F/F-F/B combination control using feedforward control and feedback control to conform the sensed fuel pressure to the target fuel pressure, wherein the controlling includes performing F/B single control for controlling the discharge amount of the high-pressure pump through only the feedback control without using the feedforward control when an operation state of the engine is an idling condition.

* * * * *